US012012822B2

(12) United States Patent
Wang et al.

(10) Patent No.: US 12,012,822 B2
(45) Date of Patent: Jun. 18, 2024

(54) ULTRA-HIGH POWER CEMENTING APPARATUS INTEGRATED WITH REMOTE CONTROL

(71) Applicant: YANTAI JEREH PETROLEUM EQUIPMENT & TECHNOLOGIES CO., LTD., Shandong (CN)

(72) Inventors: Yanfeng Wang, Shandong (CN); Enjie Li, Shandong (CN); Ren Liu, Shandong (CN); Xincheng Li, Shandong (CN); Shitang Liu, Shandong (CN); Xingtao Liu, Shandong (CN); Baoyuan Liang, Shandong (CN); Pengyuan Zhang, Shandong (CN); Mingsheng Li, Shandong (CN); Zhangye Wu, Shandong (CN)

(73) Assignee: Yantai Jereh Petroleum Equipment & Technologies Co., Ltd., Yantai (CN)

( * ) Notice: Subject to any disclaimer, the term of this patent is extended or adjusted under 35 U.S.C. 154(b) by 830 days.

(21) Appl. No.: 16/973,406

(22) PCT Filed: Apr. 16, 2018

(86) PCT No.: PCT/CN2018/083203
§ 371 (c)(1),
(2) Date: Dec. 8, 2020

(87) PCT Pub. No.: WO2019/200510
PCT Pub. Date: Oct. 24, 2019

(65) Prior Publication Data
US 2021/0172282 A1 Jun. 10, 2021

(51) Int. Cl.
*E21B 33/13* (2006.01)
*E21B 47/005* (2012.01)

(52) U.S. Cl.
CPC ..... *E21B 33/13* (2013.01); *E21B 47/005* (2020.05)

(58) Field of Classification Search
None
See application file for complete search history.

(56) References Cited

U.S. PATENT DOCUMENTS 2,957,430 A * 10/1960 Naef ..... F04B 9/105 417/403
4,782,894 A * 11/1988 LaFleur ..... E21B 33/05 166/70

(Continued)

FOREIGN PATENT DOCUMENTS

CN 25960000 Y 12/2003
CN 2934561 Y 8/2007

(Continued)

OTHER PUBLICATIONS

English Translation of CN204645658 (Year: 2015).*
English Translation of CN205477517 (Year: 2016).*

*Primary Examiner* — Daniel L Greene
(74) *Attorney, Agent, or Firm* — Crowell & Moring LLP

(57) ABSTRACT

Disclosed is an ultra-high-power cementing apparatus integrated with remote control, belonging to the field of petroleum equipment. The apparatus includes a loading system, and a secondary beam on which a hydraulic system, a power transmission system, a metering tank, an electrical system, a gas path system, a manipulation system and a mixing system are successively connected from front to rear, wherein a lower portion of the gas path system is provided with a plunger pump that is connected to a high-pressure discharge system; and a lower portion of the electrical system is provided with a manipulation platform, the (Continued)

manipulation system being located above the manipulation platform, and the manipulation system being connected to a remote control system.

19 Claims, 2 Drawing Sheets

(56) References Cited

U.S. PATENT DOCUMENTS 5,085,049 A * 2/1992 Rim ..... F01N 13/011 60/288
5,209,495 A * 5/1993 Palmour ..... F04B 53/164 277/926
7,775,265 B2 * 8/2010 Chissus ..... F28F 1/16 165/173
10,436,341 B1 * 10/2019 Hill ..... E21B 43/26
2001/0056544 A1 * 12/2001 Walker ..... B60W 50/029 180/170
2003/0132002 A1 * 7/2003 Giebeler ..... E21B 33/05 166/365
2005/0199210 A1 * 9/2005 Biess ..... F01M 5/021 60/626
2006/0207426 A1 * 9/2006 Platt ..... B01D 46/0004 95/286
2007/0041849 A1 * 2/2007 Allen ..... F04B 49/126 417/273
2014/0373755 A1 * 12/2014 Forgeron ..... B28C 5/4203 106/638
2016/0153260 A1 * 6/2016 Brothers ..... E21B 33/13 166/285
2016/0177678 A1 * 6/2016 Morris ..... E21B 41/0085 60/772
2016/0221220 A1 * 8/2016 Paige ..... B28C 9/0463
2018/0135617 A1 * 5/2018 Ma ..... F04B 53/18
2019/0043629 A1 * 2/2019 Sun ..... G21F 9/24
2019/0184378 A1 * 6/2019 Zhu ..... B01J 23/72

FOREIGN PATENT DOCUMENTS

CN 201116462 Y 9/2008
CN 201334891 Y 10/2009
CN 202827276 U 3/2013
CN 203655221 U 6/2014
CN 204532235 U 8/2015
CN 204645658 U * 9/2015
CN 205477517 U * 8/2016
CN 205477517 U 8/2016
CN 209137963 U * 7/2019
JP 5150323 B2 2/2013

* cited by examiner

ULTRA-HIGH POWER CEMENTING APPARATUS INTEGRATED WITH REMOTE CONTROL

TECHNICAL FIELD

The present invention relates to the technical field of petroleum equipment, in particular to a new ultra-high power cementing apparatus integrated with remote control.

BACKGROUND

Because of the increasing frequency of cementing operations in ultra-deep wells and complex formation wells, and the requirement for high pressure, large displacement, long time and continuous operation during ultra-deep well and ultrahigh pressure gas well cementation, high-power or ultrahigh power cementing equipment is rapidly developing. High-power motors will gradually replace the existing single-machine or double-machine cementing equipment. In the prior art, to meet the requirement for high pressure and large displacement, multiple cementing equipment with double-machine and double-pump run at the same time, which has the disadvantages of large occupied area, complex pipeline connection, high maintenance frequency, large operator number and high single operation cost.

SUMMARY

In order to solve the above technical problems, the present invention provides a new ultra-high power cementing apparatus integrated with remote control, which meets the requirement for high pressure, large displacement, long time and continuous operation during cementing operations in ultra-deep well and complex formation well at present, so as to meet the requirements for operating conditions, improve operating efficiency and save operating cost.

The technical solution for solving the above technical problems is as follows:

A new ultra-high power cementing apparatus integrated with remote control, including a loading system and an auxiliary beam, the auxiliary beam is connected to the loading system, and the auxiliary beam is connected in sequence from front to back with a hydraulic system, a power and transmission system, a metering tank, a low-pressure manifold system, an operating platform, and an electrical system, an air path system, an operation and control system, a plunger pump, a high-pressure manifold and a mixing system which are arranged at an upper end of the operating platform; the plunger pump is located at a lower part of the air path system, a rated input power of the plunger pump is larger than or equal to 1200 horsepower, and the plunger pump is connected to a high-pressure discharge system; the air path system is provided with a plug valve, the plug valve is a main switch of the air path system, a downstream end of the plug valve is provided with a filtering pressure reducing valve, and the filtering pressure reducing valve is used for adjusting the working pressure of the whole air path system and filtering the gas entering the air path system.

The operation and control system is located on a top of the operating platform, the operation and control system is connected to a remote control system, and the remote control system comprises a remote control box, a first platform, a data acquisition system and a notebook computer.

An operating system of the present invention mainly includes the operating platform and an instrument control system, the operating platform is a main place for operators to operate the equipment, and the instrument control system with an instrument box as a carrier can realize real-time monitoring and control during operation.

The power and transmission system includes an engine, a gearbox assembly, a transmission shaft, a carrying pole beam mounting assembly, an air intake system, an air exhaust system, a cooling system assembly, a fuel system, a heating system and a remote filter mounting bracket; the transmission shaft is located between the gearbox assembly and the plunger pump, and the engine and the gearbox assembly are placed on and supported by the carrying pole beam mounting assembly; the air intake system provides the engine with air required for combustion and the air exhaust system realizes waste gas and heat emission, the remote filter mounting bracket supports an intake air filter, and the cooling system assembly is used for heat dissipation of the engine, the gearbox assembly, the hydraulic system and the plunger pump; the gearbox assembly realizes the adjustment of different pressures and displacements by changing gears, and the engine outputs power to the gearbox assembly and drives the plunger pump through the transmission shaft; and as a power source of the equipment, the power system provides power for the working parts on the equipment.

The mixing system is located at a tail of the auxiliary beam, and the mixing system realizes the mixing of water and cement.

Further, the loading system is any one of a vehicle chassis, a semi-trailer chassis or a skid-mounted chassis, and serves as a bearing component of the equipment.

Further, the plunger pump is a three-cylinder plunger pump.

Further, the high-pressure discharge system includes a mud discharge manifold and a high-pressure safety valve arranged on the mud discharge manifold.

Further, an upper part of the operating platform is further provided with a packing lubrication system.

Further, a lower part of the power and transmission system is further provided with a power end lubrication system for lubricating the plunger pump.

Further, the metering tank includes a tank body, a clear water manifold is connected to a bottom of the tank body and the tank body is supplied with water by the clear water manifold, the clear water manifold is provided with a butterfly valve, and the bottom of the tank body is further provided with a discharge port; the tank body is further provided with a liquid level gauge and a second platform, the second platform is located at a top of the tank body, and the tank body is mainly used to contain and measure clean water for operation, and can also be used for mixing some chemical reagents; and the second platform can be used for observing a liquid level in the tank so as to prevent overflowing, and a filter screen is arranged inside the tank body at a position of the discharge port for filtering impurities.

Further, the low-pressure manifold system includes the clear water manifold and a mud manifold, the mud manifold includes a discharge manifold and a centrifugal pump, the centrifugal pump is controlled by a pneumatic actuator, and the discharge manifold is provided with a densimeter manifold and a butterfly valve. The clear water manifold is used for external water supply, water delivery to the metering tank and water supply to the mixing system to mix mud, etc. The mud manifold is mainly used for transporting mud and measuring the flow and density of mud.

Further, a cement adding manifold is further connected to the tail of the auxiliary beam.

Further, the high-pressure manifold is arranged at a lower part of the operation and control system. Main control components and display components of the power system and the mixing system, as well as core components of the electrical system, are integrated on the operation and control system, which is a main operation place for the equipment during operation. The operation and control system of the present invention uses the instrument box as the carrier, which mainly includes an instrument panel, instruments, control elements, etc., through which the cementing equipment can be monitored and controlled. The instrument panel is integrated with most valve instruments required for equipment operation.

The present invention has the following key assemblies:

Plunger pump and high-pressure discharge system: including the plunger pump, the plug valve, the high-pressure safety valve, a discharge pipeline, etc., which can convert low-pressure fluid such as mud, drilling fluid, acidizing fluid and slurry replacement, etc. into high-pressure fluid, and different pressures and displacements are obtained by changing plunger diameter, thus realizing liquid pumping and meeting operation requirements.

Mud mixing system: including a mud mixing tank, the metering tank, the low-pressure manifold, a high-energy mixer, an agitator, etc. A manual mud mixing system, a univariate controlled mud mixing system or a multivariate fully-automatic mud mixing system can be adopted to meet different requirements. Alternatively, an automatic mixing system can be used to automatically control an engine throttle and a gear of a gearbox according to pressure and displacement requirements, so as to completely liberate operators.

Remote control system: including the remote control box, the platform, the data acquisition system, the notebook computer, etc. The remote control system allows the operators to be away from the operating environment, and operate the cementing equipment at a distance, so as to keep away from noise and high pressure areas. The operation situation on the cementing equipment can be observed through a camera at a distance, so that the operators can be immersive and achieve the operation experience of what you see is what you get.

Hydraulic and air path system: mainly including a hydraulic pump, a hydraulic motor, a hydraulic oil tank, a hydraulic valve, a lubricating gear pump, a dryer, a air cylinder, etc., so as to provide power for the centrifugal pump, a pneumatic head and lubrication of the equipment to ensure normal operation of the equipment.

Main functions of the electrical system are:

(a) controlling the engine to start;

(b) controlling the mud mixing system;

(c) supplying power to electrical components to ensure that all indicator lights are on during operation, such as a touch screen, the instruments, a locking indicator light and an overpressure indicator light, etc;

(d) supplying power to all lighting lamps to ensure that the equipment can work at night; and (e) realizing power supply by a storage battery. After the engine is started, a generator of the engine will charge the storage battery. The voltage of all electrical devices on the equipment is 24 VDC.

One plug valve of the air path system is the main switch of the air path system. The filtering pressure reducing valve connected afterwards can not only adjust the working pressure of the whole air path system, but also filter the gas entering the system to ensure the normal operation of air path components. Its main functions are:

(a) controlling on/off of the pneumatic actuator;

(b) controlling an air horn;

(c) providing air for the packing lubrication system; and (d) providing air for a diesel spray bottle.

The hydraulic system is an open/close system, and the pressure of the hydraulic system during working depends on an external load, so as long as the system works normally below a design pressure, it means that the hydraulic system operates normally. An engine starting system, a motor drive system of a centrifugal pump, a motor drive system of a mud mixing tank agitator, a drive system of a cement discharging cylinder and a drive system of a hydraulic plug valve of the present equipment are all of a hydraulic drive type. All hydraulic components of the hydraulic system are from world-famous brands with stable and reliable performance.

A lubrication system adopts plunge pump power end lubrication and packing lubrication. Power end lubrication is composed of a set of independent systems. A gear pump is driven by the transmission side of an on-platform gearbox to apply continuous oil pressure forced lubrication to bearings and gears at a power end of the plunger pump. The gear pump sucks lubricating oil from the oil tank, the lubricating oil flows to the power end through a pipeline after passing through a pipeline filter, and then is divided into two paths: one path enters a main shaft to lubricate rolling bearings and sliding bearings of a connecting rod through holes of the main shaft, and the other path enters the gear box for lubrication, and finally the lubricating oil returns to a big pump lubricating oil tank. A safety valve is installed in front of the pipeline filter, which adjusts the pressure of the whole lubrication system. When pressure exceeds a set value, the lubricating oil flows back to the oil tank through the safety valve. The system is equipped with an automatic cooling device, which conducts cooling by means of an engine fan. When the temperature of the lubricating oil reaches a set temperature, the lubricating oil enters a cooler for heat dissipation. For packing lubrication, lubricating grease can be used to lubricate a plunge pump hydraulic end packing or centrifugal pump packing. An electric lubricating device forcibly presses the lubricating grease into the plunge pump or centrifugal pump packing. In order to avoid waste of the grease, the electric lubricating device is set to run intermittently to provide the most reasonable amount of lubricating oil for the packing. In this system, a one-way valve plays a role in preventing backflow of the lubricating grease. This lubricating fluid can use the "gas cap oil" lubrication method.

The plunger pump system mainly realizes different plungers, pressures, etc. to obtain different pressures and displacements required by end customers, so as to meet customer requirements.

The high-pressure manifold system is the general name of high-pressure pipe fittings of the equipment, which mainly consists of a 2" plug valve, a 2"×1" plug valve, a 2" safety valve, a pressure sensor, an integral straight pipeline, a high-pressure tee, a high-pressure elbow, etc. The high-pressure manifold system mainly realizes the connection between the plunger pump and various plug valves, and extends the discharge port to a suitable position for external connection to a well site, and has other functions such as pressure measurement, manifold switch control, pressure relief and overpressure protection, etc.

The mixing system assembly is mainly used for mixing cement slurry, and mainly includes a mud mixing tank, a spray mixer, a cement discharge valve, a diffusion box, a defoamer container, a stirring shaft, a cement adding manifold, etc. A high-energy mixer is a core component of the whole mud mixing system assembly. Clear water entering from the clear water manifold, cement entering from the cement discharge valve and cement slurry circulating through a secondary circulation manifold are mixed in the high-energy mixer, which is a main component for mud mixing. The cement adding manifold is a pipeline which provides dry cement for the mud mixing system of the equipment, and includes a connecting pipeline, a cement adding hose and a control butterfly valve, etc.

The present invention has the beneficial effects that:

(1) the requirement for high pressure, large displacement, long time and continuous operation during ultra-deep well cementing operation and ultrahigh pressure gas well cementing operation is met;

(2) the operation space of the equipment is reduced so that complex operation can be conducted in a small well site, and the occupied area of the equipment is small, compared with the arrangement of multiple conventional cementing trucks, it is more conducive to the rapid arrangement of well site equipment and improves field operation efficiency;

(3) pipeline connection is easy, maintenance frequency is low, the number of required operators is small, and the cost of single operation is low;

(4) intelligent design reduces manual errors, one-touch operation realizes automatic control of the engine throttle and the gear of the gear box, and operators are completely liberated, marking a key step towards smart oilfield; and (5) both safety and efficiency are guaranteed, and the equipment is equipped with the remote control system, which allows the operators to be away from noisy and high-pressure areas and complete operation in an immersive mode, thus ensuring the safety of both equipment and personnel.

The present invention will be further described below with reference to the accompanying drawings and specific embodiments.

Figure 1:
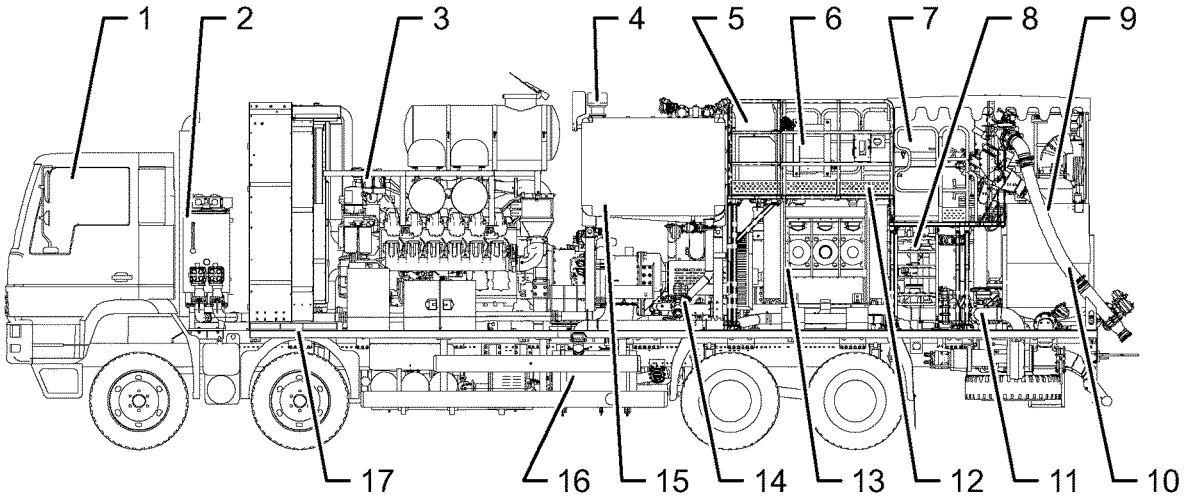
FIG. 1 is a schematic diagram of a plane structure of the present invention.

In the drawings: 1: loading system, 2: hydraulic system, 3: power and transmission system, 4: electrical system, 5: air path system, 6: packing lubrication system, 7: operation and control system, 8: high-pressure manifold, 9: mixing system, 10: cement adding manifold, 11: mud discharge manifold, 12: operating platform, 13: plunger pump, 14: clear water manifold, 15: metering tank, 16: power end lubrication system, 17: auxiliary beam, 18: transmission shaft, 19: carrying pole beam mounting assembly, 20: engine, 21: gearbox assembly, 22: air intake system, 23: air exhaust system, 24: remote filter mounting bracket, 25: cooling system assembly.

DETAILED DESCRIPTION

Embodiment 1

Figure 2:
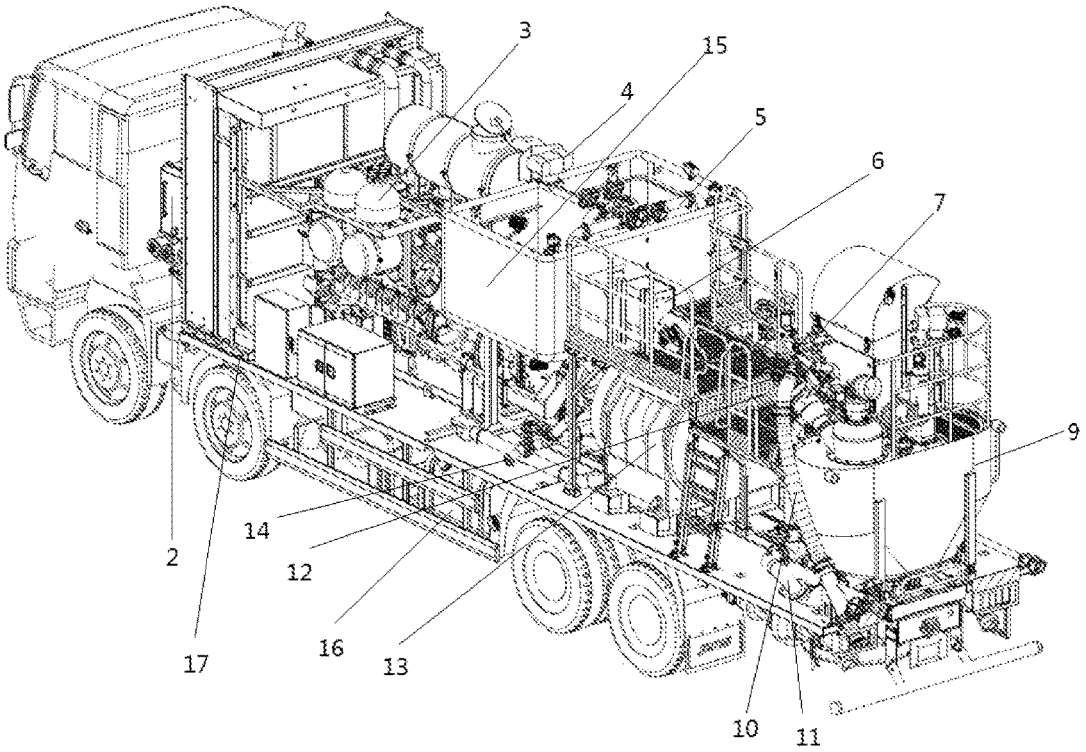
FIG. 2 is a schematic diagram of a three-dimensional structure of the present invention.
Figure 3:
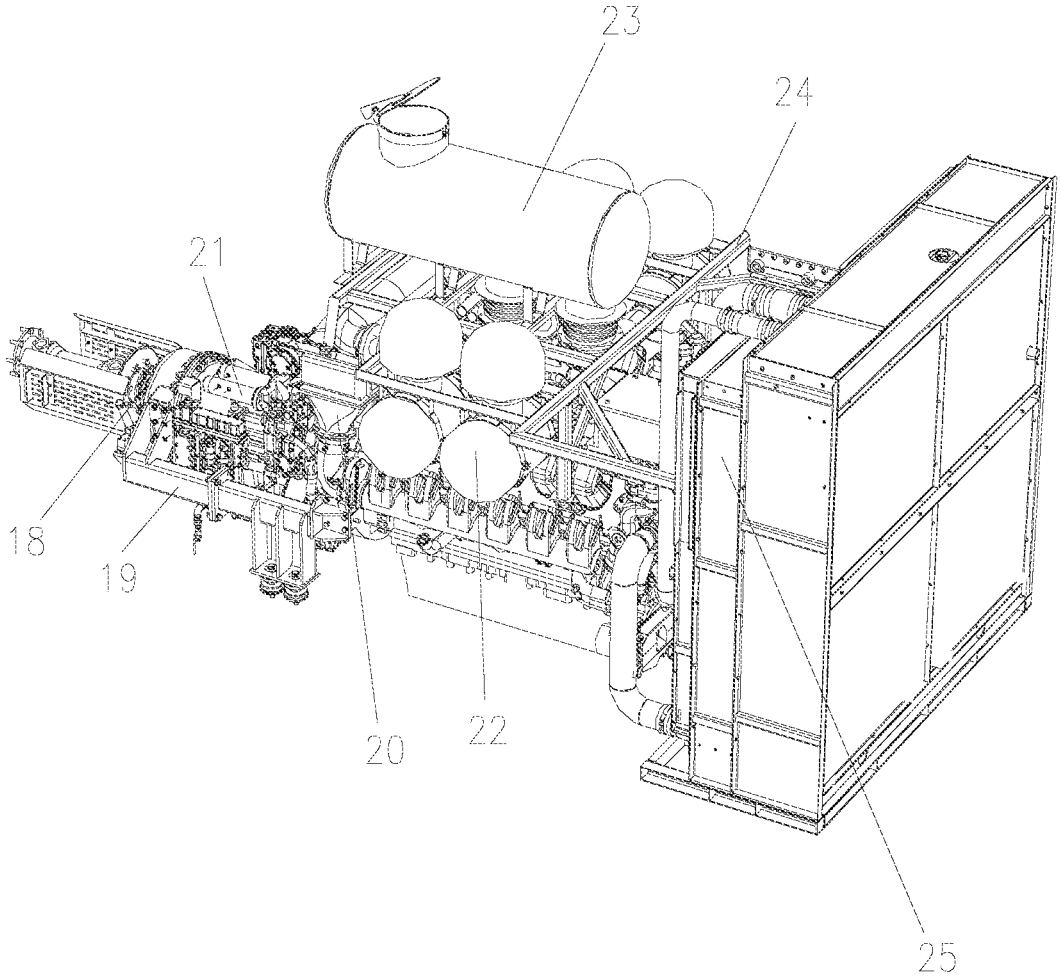
FIG. 3 is a schematic structural diagram of a power and transmission system.

As illustrated in FIGS. 1-3, a new ultra-high power cementing apparatus integrated with remote control includes a loading system 1 and an auxiliary beam 17, the auxiliary beam 17 is connected to the loading system 1, and the auxiliary beam 17 is connected in sequence from front to back with a hydraulic system 2, a power and transmission system 3, a metering tank 15, a low-pressure manifold system, an operating platform 12, and those arranged at an upper end of the operating platform 12 that are an electrical system 4, an air path system 5, an operation and control system 7, a plunger pump 13, a high-pressure manifold 8 and a mixing system 9; the plunger pump 13 is located at a lower part of the air path system 5, the rated input power of the plunger pump 13 is larger than or equal to 1200 horsepower, and the plunger pump 13 is connected to a high-pressure discharge system; the air path system 5 is provided with a plug valve, the plug valve is a main switch of the air path system, a downstream end of the plug valve is provided with a filtering pressure reducing valve, and the filtering pressure reducing valve is used for adjusting the working pressure of the whole air path system and filtering the gas entering the air path system.

The operation and control system 7 is located on a top of the operating platform 12, the operation and control system 7 is connected to a remote control system, and the remote control system includes a remote control box, a first platform, a data acquisition system and a notebook computer (not illustrated in the figure).

The power and transmission system 3 includes an engine 20, a gearbox assembly 21, a transmission shaft 18, a carrying pole beam mounting assembly 19, an air intake system 22, an air exhaust system 23, a cooling system assembly 25, a fuel system, a heating system and a remote filter mounting bracket 24; the transmission shaft 18 is located between the gearbox assembly 21 and the plunger pump 13, and the engine 20 and the gearbox assembly 21 are placed on and supported by the carrying pole beam mounting assembly 19; the air intake system 22 provides the engine 20 with air required for combustion and the air exhaust system 23 realizes waste gas and heat emission, the remote filter mounting bracket 24 supports an intake air filter, and the cooling system assembly 25 is used for heat dissipation of the engine 20, the gearbox assembly 21, the hydraulic system 2 and the plunger pump 13; the gearbox assembly 21 realizes the adjustment of pressures and displacements by changing gears, and the engine 20 outputs power to the gearbox assembly 21 and drives the plunger pump 13 through the transmission shaft 18.

The mixing system 9 is located at a tail of the auxiliary beam 17, and the mixing system 9 realizes the mixing of water and cement.

The loading system 1 is a vehicle chassis.

The plunger pump 13 is a three-cylinder plunger pump.

The high-pressure discharge system includes a mud discharge manifold 11 and a high-pressure safety valve arranged on the mud discharge manifold 11.

An upper part of the operating platform 12 is further provided with a packing lubrication system 6.

A lower part of the power and transmission system 3 is further provided with a power end lubrication system for lubricating the plunger pump 13.

The metering tank 15 includes a tank body, a clear water manifold 14 is connected to a bottom of the tank body and the tank body is supplied with water by the clear water manifold 14, the clear water manifold 14 is provided with a butterfly valve, and the bottom of the tank body is further provided with a discharge port; and the tank body is further provided with a liquid level gauge and a second platform, the second platform is located at a top of the tank body, and a filter screen is arranged inside the tank body at a position of the discharge port.

The low-pressure manifold system includes the clear water manifold 14 and a mud manifold, wherein the mud manifold includes a discharge manifold and a centrifugal pump, the centrifugal pump is controlled by a pneumatic actuator, and the discharge manifold is provided with a densimeter manifold and a butterfly valve.

A cement adding manifold 10 is further connected to a tail of the auxiliary beam 17.

The high-pressure manifold 8 is arranged at a lower part of the operation and control system 7.

Embodiment 2

A new ultra-high power cementing apparatus integrated with remote control, including a loading system 1 and an auxiliary beam 17, the auxiliary beam 17 is connected to the loading system 1, and the auxiliary beam 17 is connected in sequence from front to back with a hydraulic system 2, a power and transmission system 3, a metering tank 15, a low-pressure manifold system, an operating platform 12, and those arranged at an upper end of the operating platform 12 that are an electrical system 4, an air path system 5, an operation and control system 7, a plunger pump 13, a high-pressure manifold 8 and a mixing system 9; the plunger pump 13 is located at a lower part of the air path system 5, the rated input power of the plunger pump 13 is larger than or equal to 1200 horsepower, and the plunger pump 13 is connected to a high-pressure discharge system; the air path system 5 is provided with a plug valve, the plug valve is a main switch of the air path system, a downstream end of the plug valve is provided with a filtering pressure reducing valve, and the filtering pressure reducing valve is used for adjusting the working pressure of the whole air path system and filtering the gas entering the air path system.

The operation and control system 7 is located on a top of the operating platform 12, the operation and control system 7 is connected to a remote control system, and the remote control system includes a remote control box, a first platform, a data acquisition system and a notebook computer (not illustrated in the figure).

The power and transmission system 3 includes an engine 20, a gearbox assembly 21, a transmission shaft 18, a carrying pole beam mounting assembly 19, an air intake system 22, an air exhaust system 23, a cooling system assembly 25, a fuel system, a heating system and a remote filter mounting bracket 24; the transmission shaft 18 is located between the gearbox assembly 21 and the plunger pump 13, and the engine 20 and the gearbox assembly 21 are placed on and supported by the carrying pole beam mounting assembly 19; the air intake system 22 provides the engine 20 with air required for combustion and the air exhaust system 23 realizes waste gas and heat emission, the remote filter mounting bracket 24 supports an intake air filter, and the cooling system assembly 25 is used for heat dissipation of the engine 20, the gearbox assembly 21, the hydraulic system 2 and the plunger pump 13; the gearbox assembly 21 realizes the adjustment of pressures and displacements by changing gears, and the engine 20 outputs power to the gearbox assembly 21 and drives the plunger pump 13 through the transmission shaft 18.

The mixing system 9 is located at a tail of the auxiliary beam 17, and the mixing system 9 realizes the mixing of water and cement.

The loading system 1 is a semi-trailer chassis.

The plunger pump 13 is a three-cylinder plunger pump.

The high-pressure discharge system includes a discharge mud manifold 11 and a high-pressure safety valve arranged on the discharge mud manifold 11.

An upper part of the operating platform 12 is further provided with a packing lubrication system 6.

A lower part of the power and transmission system 3 is further provided with a power end lubrication system 16 for lubricating the plunger pump 13.

The metering tank 15 includes a tank body, a clear water manifold 14 is connected to a bottom of the tank body and the tank body is supplied with water by the clear water manifold 14, the clear water manifold 14 is provided with a butterfly valve, and the bottom of the tank body is further provided with a discharge port; and the tank body is further provided with a liquid level gauge and a second platform, the second platform is located at a top of the tank body, and a filter screen is arranged inside the tank body at a position of the discharge port.

The low-pressure manifold system includes the clear water manifold 14 and a mud manifold, wherein the mud manifold includes a discharge manifold and a centrifugal pump, the centrifugal pump is controlled by a pneumatic actuator, and the discharge manifold is provided with a densimeter manifold and a butterfly valve.

A cement adding manifold 10 is further connected to a tail of the auxiliary beam 17.

The high-pressure manifold 8 is arranged at a lower part of the operation and control system 7.

Embodiment 3

A new ultra-high power cementing apparatus integrated with remote control, including a loading system 1 and an auxiliary beam 17, the auxiliary beam 17 is connected to the loading system 1, and the auxiliary beam 17 is connected in sequence from front to back with a hydraulic system 2, a power and transmission system 3, a metering tank 15, a low-pressure manifold system, an operating platform 12, and those arranged at an upper end of the operating platform 12 that are an electrical system 4, an air path system 5, an operation and control system 7, a plunger pump 13, a high-pressure manifold 8 and a mixing system 9; the plunger pump 13 is located at a lower part of the air path system 5, the rated input power of the plunger pump 13 is larger than or equal to 1200 horsepower, and the plunger pump 13 is connected to a high-pressure discharge system; the air path system 5 is provided with a plug valve, the plug valve is a main switch of the air path system, a downstream end of the plug valve is provided with a filtering pressure reducing valve, and the filtering pressure reducing valve is used for adjusting the working pressure of the whole air path system and filtering the gas entering the air path system.

The operation and control system 7 is located on a top of the operating platform 12, the operation and control system 7 is connected to a remote control system, and the remote control system includes a remote control box, a first platform, a data acquisition system and a notebook computer (not illustrated in the figure).

The power and transmission system 3 includes an engine 20, a gearbox assembly 21, a transmission shaft 18, a carrying pole beam mounting assembly 19, an air intake system 22, an air exhaust system 23, a cooling system assembly 25, a fuel system, a heating system and a remote filter mounting bracket 24; the transmission shaft 18 is located between the gearbox assembly 21 and the plunger pump 13, and the engine 20 and the gearbox assembly 21 are placed on and supported by the carrying pole beam mounting assembly 19; the air intake system 22 provides the engine 20 with air required for combustion and the air exhaust system 23 realizes waste gas and heat emission, the remote filter mounting bracket 24 supports an intake air filter, and the cooling system assembly 25 is used for heat dissipation of the engine 20, the gearbox assembly 21, the hydraulic system 2 and the plunger pump 13; the gearbox assembly 21 realizes the adjustment of pressures and displacements by changing gears, and the engine 20 outputs power to the gearbox assembly 21 and drives the plunger pump 13 through the transmission shaft 18.

The mixing system 9 is located at a tail of the auxiliary beam 17, and the mixing system 9 realizes the mixing of water and cement.

The loading system 1 is a skid-mounted chassis.

The plunger pump 13 is a three-cylinder plunger pump.

The high-pressure discharge system includes a discharge mud manifold 11 and a high-pressure safety valve arranged on the discharge mud manifold 11.

An upper part of the operating platform 12 is further provided with a packing lubrication system 6.

A lower part of the power and transmission system 3 is further provided with a power end lubrication system 16 for lubricating the plunger pump 13.

The metering tank 15 includes a tank body, a clear water manifold 14 is connected to a bottom of the tank body and the tank body is supplied with water by the clear water manifold 14, the clear water manifold 14 is provided with a butterfly valve, and the bottom of the tank body is further provided with a discharge port; and the tank body is further provided with a liquid level gauge and a second platform, the second platform is located at a top of the tank body, and a filter screen is arranged inside the tank body at a position of the discharge port.

The low-pressure manifold system includes the clear water manifold 14 and a mud manifold, wherein the mud manifold includes a discharge manifold and a centrifugal pump, the centrifugal pump is controlled by a pneumatic actuator, and the discharge manifold is provided with a densimeter manifold and a butterfly valve.

A cement adding manifold 10 is further connected to a tail of the auxiliary beam 17.

The high-pressure manifold 8 is arranged at a lower part of the operation and control system 7.

The above are only preferred embodiments of the present invention, and does not limit the present invention in any form. Any simple modifications and equivalent changes made to the above embodiments according to the technology of the present invention fall within the protection scope of the present invention.

The invention claimed is:

1. A cementing apparatus operable by remote control, comprising a loading system and an auxiliary beam, the auxiliary beam being connected to the loading system, wherein the auxiliary beam is connected with a power and transmission system, an operation and control system, a plunger pump and a high-pressure discharge system; a rated input power of the plunger pump is larger than or equal to 1200 horsepower, and the plunger pump is connected to the high-pressure discharge system to discharge a cement mixture;

the power and transmission system comprises an engine, a gearbox assembly and a transmission shaft, the transmission shaft is located between the gearbox assembly and the plunger pump, the gearbox assembly realizes an adjustment of different pressures and displacements by changing gears, the engine outputs power to the gearbox assembly, and the gearbox assembly drives the plunger pump through the transmission shaft; and an operating platform above the plunger pump for hosting at least the operation and control system, wherein the operation and control system is configured to enable a cementing operation of the cementing apparatus by remote control.

2. The cementing apparatus operable by remote control according to claim 1, wherein the loading system is any one of a vehicle chassis, a semi-trailer chassis or a skid-mounted chassis.

3. The cementing apparatus operable by remote control according to claim 1, wherein the plunger pump is a three-cylinder plunger pump.

4. The cementing apparatus operable by remote control according to claim 1, wherein the high-pressure discharge system comprises a mud discharge manifold and a high-pressure safety valve arranged on the mud discharge manifold.

5. The cementing apparatus operable by remote control according to claim 1, wherein the auxiliary beam is further connected with a cement charge manifold.

6. The cementing apparatus operable by remote control according to claim 1, wherein the auxiliary beam is further provided with a hydraulic system, a metering tank, a low-pressure manifold system, the operating platform, an electrical system, an air path system, a high-pressure manifold and a mixing system, and the hydraulic system, the power and transmission system, the metering tank, the low-pressure manifold system and the operating platform are connected in sequence.

7. The cementing apparatus operable by remote control according to claim 6, wherein the electrical system, the air path system, and the operation and control system are arranged on the operating platform.

8. The cementing apparatus operable by remote control according to claim 6, further comprising an engine starting system, a motor drive system of a centrifugal pump, a motor drive system of a mud mixing tank agitator, a drive system of a cement discharging cylinder and a drive system of a hydraulic plug valve, and the hydraulic system being configured to drive the engine starting system, the motor drive system of a centrifugal pump, the motor drive system of a mud mixing tank agitator, the drive system of a cement discharging cylinder and the drive system of a hydraulic plug valve.

9. The cementing apparatus operable by remote control according to claim 6, wherein the air path system is provided with a plug valve, the plug valve is a main switch of the air path system, a downstream end of the plug valve is provided with a filtering pressure reducing valve, and the filtering pressure reducing valve is configured to adjust a working pressure of the air path system and filter gas entering the air path system.

10. The cementing apparatus operable by remote control according to claim 6, wherein the mixing system is at a tail of the auxiliary beam, and the mixing system realizes a mixing of water and cement.

11. The cementing apparatus operable by remote control according to claim 6, wherein the operating platform is further provided with a packing lubrication system.

12. The cementing apparatus operable by remote control according to claim 6, wherein the metering tank comprises a tank body, a clear water manifold is connected to a bottom of the tank body and the tank body is supplied with water by the clear water manifold, the clear water manifold is provided with a butterfly valve, and the bottom of the tank body is further provided with a discharge port; and the tank body is further provided with a liquid level gauge and a second platform, and a filter screen is arranged inside the tank body at a position of the discharge port.

13. The cementing apparatus operable by remote control according to claim 6, wherein the low-pressure manifold system comprises a clear water manifold and a mud manifold, the mud manifold comprises a discharge manifold and a centrifugal pump, the centrifugal pump is controlled by a pneumatic actuator, and the discharge manifold is provided with a densimeter manifold and a butterfly valve.

14. The cementing apparatus operable by remote control according to claim 6, wherein the high-pressure manifold is below the operating platform and positioned between the operation and control system and the auxiliary beam.

15. The cementing apparatus operable by remote control according to claim 1, wherein the power and transmission system further comprises a carrying pole beam mounting assembly over the auxiliary beam, and the engine and the gearbox assembly are placed on the carrying pole beam mounting assembly.

16. The cementing apparatus operable by remote control according to claim 15, wherein the power and transmission system further comprises an air intake system and an air exhaust system, the air intake system provides the engine with air required for combustion and the air exhaust system realizes waste gas and heat emission.

17. The cementing apparatus operable by remote control according to claim 16, wherein the power and transmission system further comprises a cooling system assembly, a fuel system, a heating system and a remote filter mounting bracket, the cooling system assembly is configured to provide heat dissipation for the engine, the gearbox assembly and the plunger pump.

18. The cementing apparatus operable by remote control according to claim 1, wherein the power and transmission system is further provided with a power end lubrication system for lubricating the plunger pump.

19. The cementing apparatus operable by remote control according to claim 18, wherein the power end lubrication system comprises a gear pump and a pipeline filter, the gear pump sucks lubricating oil from an oil tank, and the lubricating oil flows to a power end of the plunger pump through the pipeline filter.

* * * * *